US005200047A

United States Patent [19]

Hashimoto et al.

[11] Patent Number: 5,200,047

[45] Date of Patent: Apr. 6, 1993

[54] PLATING SOLUTION AUTOMATIC CONTROL

[75] Inventors: Shigeo Hashimoto, Ikoma; Yutaka Sugiura, Kobe, both of Japan

[73] Assignee: C. Uyemura & Co., Ltd., Osaka, Japan

[21] Appl. No.: 842,507

[22] Filed: Feb. 27, 1992

Related U.S. Application Data

[60] Division of Ser. No. 406,863, Sep. 13, 1989, which is a continuation of Ser. No. 213,488, Jun. 30, 1988, abandoned, which is a continuation of Ser. No. 895,912, Aug. 13, 1986, abandoned.

[51] Int. Cl.[5] ..... C23F 13/00

[52] U.S. Cl. ..... 204/194

[58] Field of Search ..... 204/194; 427/8-10

[56] References Cited

U.S. PATENT DOCUMENTS 4,286,965 9/1981 Vanhumbeech et al. .
4,331,699 5/1982 Suzuki et al. .
4,406,249 9/1983 Araki et al. .
4,406,250 9/1983 Araki et al. .
4,479,980 10/1984 Acosta et al. .
4,556,845 12/1985 Strope et al. .
4,623,554 11/1986 Kaschak et al. .

*Primary Examiner*—Sam Silverberg

[57] ABSTRACT

The concentration of a plating solution in which a workpiece is plated is automatically controlled within a permissible range by replenishing a consumable ingredient to the plating solution in an amount corresponding to the amount of consumption estimated from the surface area of the workpiece for a given plating solution composition under given plating conditions. By measuring the concentration of the consumable ingredient in the plating solution, the replenishment of consumable ingredient is interrupted for a predetermined time or the amount of the consumable ingredient replenished is reduced when the measured concentration is above the permissible range, or the amount of consumable ingredient replenished is increased or a necessary amount of the consumable ingredient is additionally supplied to the plating solution separately from the normal replenishment of consumable ingredient when the measured concentration is below the permissible range.

1 Claim, 2 Drawing Sheets

PLATING SOLUTION AUTOMATIC CONTROL

This application is a divisional of copending application Ser. No. 07/406,863, filed on Sep. 13, 1989; allowed which is a continuation of Ser. No. 07/213,488 filed on Jun. 30, 1988 abandoned which is a continuation of Ser. No. 06/895,912, abandoned filed on Aug. 13, 1986 the entire contents of which are hereby incorporated by reference.

BACKGROUND OF THE INVENTION

This invention relates to a plating solution automatic control method, and more particularly, to such an automatic control method useful in controlling electroless plating solutions and electroplating solutions.

Some prior art known methods for the automatic control of an electroless plating solution involve automatically analyzing the concentration of a consumable ingredient in the solution. When the result of analysis shows that the concentration of the consumable ingredient in the solution is below a predetermined level, a necessary amount of a replenisher is automatically supplied to the solution to restore the concentration to the predetermined level.

This type of plating solution automatic control method includes the steps of sampling the plating solution, thereafter analyzing the sample to determine the concentration of a consumable ingredient, detecting from the result of analysis whether or not the concentration is reduced below the predetermined level, and supplying a necessary amount of replenisher to the solution. Thus there is a time lag between the sampling and the replenishment. Consequently, a substantial difference sometimes occurs between the concentrations of the consumable ingredient in the solution at the time of sampling and at the time of supplying the replenisher. The latter concentration can be considerably lower than the former concentration. Under such circumstances, the supply of replenisher which is determined on the basis of the concentration of the consumable ingredient in the solution at the time of sampling will not be sufficient to adjust the concentration of the consumable ingredient to the predetermined level. The time lag from sampling to replenisher supply is increased when the analysis technique used is a titration using a chemical reagent. The time lag, the difference between concentrations of the consumable ingredient at the times of sampling and replenisher supply due to such a time lag, and the insufficient adjustment in that the supply of replenisher does not adjust the concentration to the predetermined level because of such a concentration difference are problems encountered in strictly controlling the plating solution concentration within a narrow range for the purpose of producing plating films with consistent physical properties at a constant plating speed.

Such problems arise not only in electroless plating processes, but also in electroplating processes, particularly high speed electroplating processes accompanying rapid ingredient consumption and electroplating processes using insoluble anodes.

SUMMARY OF THE INVENTION

It is an object of the present invention to provide a plating solution automatic control method which can maintain the plating solution concentration within a relatively narrow permissible range and thus ensures that plating films having desired physical properties are consistently produced at a constant plating speed.

According to the present invention, there is provided a method for the automatic control of a plating solution in which a workpiece is plated, comprising the steps of:

computing from the surface area of the workpiece to be plated, the deposition amount per unit time available from the plating solution having a given composition under given plating conditions, computing from the computed deposition amount, the amount per unit time of a consumable ingredient in the plating solution to be consumed through the progress of plating, replenishing the consumable ingredient to the plating solution in an amount corresponding to the computed consumption amount, continuously or intermittently measuring the concentration of the consumable ingredient in the plating solution, interrupting the replenishment of the consumable ingredient for a predetermined time or reducing the amount of the consumable ingredient replenished when the measured concentration is above a predetermined permissible concentration range, and increasing the amount of the consumable ingredient replenished or additionally supplying a necessary amount of the consumable ingredient to the plating solution separately from said replenishment of the ingredient when the measured concentration is below the predetermined permissible concentration range.

The present invention is predicated on a unique concept completely different from the prior art plating solution control methods wherein the plating solution is analyzed and the replenisher is supplied on the basis of the result of analysis to maintain the plating solution concentration within a predetermined permissible range. That is, the present control method maintains the concentration of a consumable ingredient in a plating solution within a predetermined permissible concentration range by supplying the replenisher in an amount corresponding to the amount of the consumable ingredient to be consumed which is determined from the surface area of a workpiece to be plated. The present control method further determines whether the plating solution concentration is maintained within the predetermined permissible range by analyzing the solution. When it is detected that the measured concentration is outside the permissible concentration range, the supply of replenisher is interrupted or the amount of replenisher supplied is reduced, or the amount of replenisher supplied is increased or a necessary amount of replenisher is separately added, thereby restoring the plating solution concentration to within the predetermined permissible range.

Our discovery is illustrated in more detail herein below. For a given plating solution composition, the amount of deposition per unit surface area of a workpiece to be plated is calculable by the state of the art technique, provided that plating conditions are fixed. More particularly, the plating temperature and bath ratio are fixed in the case of electroless plating solution or the current density is fixed in the case of electroplating solution The term "bath ratio" used herein means the surface area of a workpiece per liter of the plating solution Thus, if the surface area of the workpiece is first determined, then the amount of deposition per unit time is estimated. The amount of the consumable ingredient to be consumed from the plating solution in the progress of plating, which corresponds to the deposition amount, is then estimated. By supplying the consumable ingredient in an amount corresponding to the estimated consumption amount, the plating solution concentration is maintained within the predetermined narrow permissible range in a program control manner. This is what we have discovered. To insure that the plating solution concentration be maintained within the predetermined permissible range, the plating solution is analyzed to gain data for a feedback control. This insures that the plating solution concentration be more positively maintained within the narrow permissible range.

In the analysis of the plating solution, the solution is first sampled and analyzed whether or not the plating solution concentration is maintained within the permissible range. When the plating solution concentration is not maintained within the permissible range, an adjustment is made by interrupting the supply of the replenisher based on the determination of the surface area of workpiece or reducing the supply amount, or increasing the supply amount or providing an additional supply. Any probable time lag between the point of time of sampling and the subsequent point of time of adjustment have no influence on the control of plating solution concentration according to the present method, because the present control method substantially depends on the replenishment based on the mathematical estimation from the surface area of the workpiece. The plating solution concentration can deviate from the permissible range to only a small least extent, because the supply of the replenisher based on the estimation from the surface area of the workpiece is continued. As opposed to a considerable variation in plating solution concentration encountered in the prior art control methods solely depending on the analysis of the plating solution, the present control method affords a minimized variation of plating solution concentration Even when the plating solution concentration has deviated from the permissible range, the present control method can restore the concentration to within the permissible range by confirming the plating solution concentration by analysis thereof and regulating the supply of replenisher based on the surface area of the workpiece. Thus, the present control method insures that the plating solution concentration be positively maintained within the predetermined narrow permissible range, and thus permits the consistent formation of deposits with desired physical properties at a constant plating speed.

BRIEF DESCRIPTION OF THE DRAWINGS

The invention will be more fully understood by reading the following description taken in conjunction with the accompanying drawings, in which.

DESCRIPTION OF THE PREFERRED EMBODIMENTS

Figure 1:
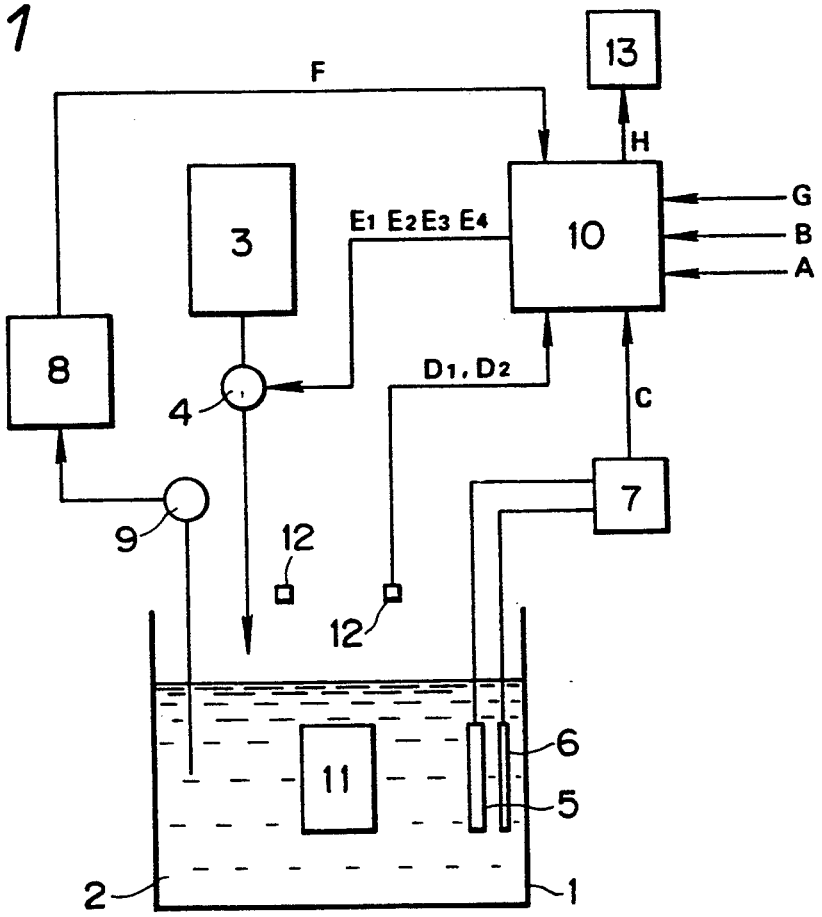
FIG. 1 is a block diagram showing an apparatus for use in one embodiment of the present control method.

Referring to FIG. 1, there is illustrated one example of an apparatus designed for controlling an electroless copper plating solution. It is described hereinafter how to control the electroless copper plating solution using this apparatus although the present invention is not limited thereto.

A plating tank 1 contains an electroless copper plating solution 2 therein. A make-up tank 3 contains a replenisher which is metered to the plating tank 1 by a metering pump 4 to provide replenishment to the plating solution. Disposed in the plating tank 1 are a heater 5 and a thermometer 6. They are both interconnected to a thermoregulator 7 to controllably maintain the solution 2 in the plating tank 1 at the predetermined temperature. An analyzer 8 has a sampling line extended from the plating tank 1 through a pump 9. Samples of the plating solution 2 are pumped to the analyzer 8 where the concentration of necessary ingredients in the solution is analyzed. A detector 12 is located above the plating tank 1 for detecting whether or not a workpiece 11 to be plated is introduced in the plating solution 2.

The apparatus further includes a control unit 10 having a computer incorporated therein and interconnected to the pump 4, thermoregulator 7, and analyzer 8. The control unit 10 has stored therein a set of information bits A relating to a plating solution composition and the deposition amounts per unit time from the plating solution at varying temperatures and bath ratios, or the amount of a consumable ingredient to be consumed, or the amount of a replenisher to be supplied. It should be noted that the deposition amount corresponds to the consumed amount of a consumable ingredient, which in turn, corresponds to the amount of a replenisher to be supplied. In other words, when any one of the above three amounts is computed or determined, the remaining two amounts can be computed or determined from the former amount.

Provision is made such that the control unit 10 will receive a set of information bits B relating to the surface area of a workpiece to be plated and a set of information bits C relating to the temperature of the plating solution from the thermoregulator 7. Upon receipt of surface area information B and temperature information C, the control unit 10 computes the amount of plating film to be deposited on the workpiece per unit time, or the amount of a consumable ingredient to be consumed, or the amount of replenisher to be supplied, all in estimation. When the workpiece 11 is dipped in the plating tank 1, the detector 12 delivers a signal D1 indicative of the presence of the workpiece in the tank to the control unit 10. The control unit 10 then supplies a signal E1 based on the result of the preceding computation to the metering pump 4 to actuate the pump so as to provide a predetermined flow rate for a predetermined time, thereby making up the plating solution 2 with a predetermined amount of the replenishment over a predetermined time. When the workpiece 11 is thereafter taken out of the plating tank 1, the detector 12 gives another signal D2 indicative of the absence of the workpiece in the tank to the control unit 10. The control unit 10 then supplies another signal E2 to the metering pump 4 to interrupt the operation thereof.

The control unit 10 is connected to the analyzer 8 whereby a set of information bits F relating to the concentration of consumable ingredient is delivered from the analyzer 8 to the control unit 10. Comparing information F with a previously stored set of information bits G relating to the permissible concentration range of the consumable ingredient in the plating solution 2, the control unit 10 delivers a signal E3 to the metering pump 4 to interrupt its operation for a predetermined time to thereby interrupt the supply of the replenisher for the predetermined time when the concentration of consumable ingredient in the plating solution 2 exceeds the permissible concentration range. The control unit 10 delivers another signal E4 to the metering pump 4 when the concentration of consumable ingredient in the plating solution 2 is below the permissible concentration range. The signal E4 commands the metering pump 4 to increase the flow rate therethrough by a predetermined quantity and/or extend the operating duration thereof by a predetermined time to thereby increase the supply of the replenisher by a predetermined amount.

The electroless copper plating solution is controlled by means of the above-mentioned apparatus by first heating the plating solution 2 with the heater 5. In general, the plating temperature is in the range of 20° C. to 80° C. The thermometer 6 takes the temperature of the plating solution 2 and the thermoregulator 7 functions to turn on or off the heater 5 in accordance with the measurement of the thermometer 6 so as to maintain the plating solution temperature at a preset level. At the same time, the thermoregulator 7 supplies temperature information C to the control unit 10. Information B relating to the surface area of a workpiece to be subjected to electroless plating is also input to the control unit 10. Upon receipt of surface area information B and temperature information C, the control unit 10, which has stored therein information A relating to the estimated deposition amounts or the amount of consumable ingredient to be consumed or the amount of replenisher to be supplied, computes the deposition amount on the workpiece per unit time or the amount of consumable ingredient to be consumed or the amount of replenisher to be supplied. Now the workpiece 11 is admitted into the plating tank 1. The detector 12 senses the presence of the workpiece and delivers the signal D to the control unit 10. Upon receipt of the signal D, the control unit 10 delivers the signal E to the metering pump 4 to control the pump in accordance with the result of the preceding computation so as to provide a predetermined flow rate and/or turn on and off at predetermined time intervals. In this way, the replenishment is supplied from the make-up tank 3 to the electroless copper plating solution 2 in an amount corresponding to the amount of the consumable ingredient consumed from the plating solution which in turn corresponds to the composition and temperature of the plating solution 2 and the surface area of the workpiece 11.

The consumable ingredients in an electroless copper plating solution are cupric ion, a reducing agent such as formalin, and an alkali such as sodium hydroxide and ammonia. In general, the electroless copper plating solution contains as main ingredients cupric ion in an amount of 0.01 to 1 mol/liter, especially 0.02 to 0.5 mol/liter in the form of a water-soluble copper salt such as cupric sulfate, cupric chloride, etc., a reducing agent such as formalin in an amount of 0.02 to 0.5 mol/liter, especially 0.02 to 0.1 mol/liter, a cupric-ion complexing agent such as an amine including ethylenediamine, ethylenediaminetetraacetic acid and its salts, tartaric acid and its salts, Rochelle salt, citric acid and its salts, etc. in such an amount that the molar concentration thereof is equal to or higher than the molar concentration of the cupric ion, and an alkali such as sodium hydroxide and ammonia in such an amount that the pH of the solution is higher than 7, particularly 11 to 13.5. The electroless copper plating solution may also contain an effective amount of a stabilizer, for example, cyanides such as potassium cyanide, thiocyanides such as potassium thiocyanide, pyridyls such as $\alpha,\alpha'$-dipyridyl, metal-cyanothiocyan complexes such as potassium ferrocyanide, phenanthrolines, etc., and other additives, for example, glycine, sarcosine and the like. Among the above-mentioned ingredients, the cupric ion, reducing agent, and alkali are consumed and the pH of the electroless copper plating solution lowers as the plating proceeds. Therefore, the cupric ion, reducing agent, and alkali should be replenished. The complexing agent is not essentially consumed except that it is dragged out. The stabilizer is also consumed during the plating although its consumption rate is not so high as those of the cupric ion, reducing agent, and alkali. Replenishment of the stabilizer may be carried out at most several times a day although it can be replenished little by little along with replenishment of the cupric ion, reducing agent, and alkali.

While the plating solution 2 is consumed of its consumable ingredients during the plating of the workpiece 11, the consumable ingredients are replenished in substantially the same amount as consumed. Thus the concentration of the consumable ingredients is always kept substantially constant.

After the workpiece 11 has been subjected to electroless copper plating to a predetermined deposit thickness, it is removed from the plating tank 1. The detector 12 senses the removal of the workpiece 11 from the tank 1 and produces a signal D2 to the control unit 10, which in turn delivers a signal E2 to the metering pump 4 to interrupt the operation thereof to stop the supply of the replenisher.

A similar control process is followed when it is desired to plate a fresh workpiece 11. The flow rate and operating time of the metering pump 4 are determined on the basis of a set of information bits B relating to the surface area of the new workpiece, thereby supplying the replenisher in an amount corresponding to the amount of consumable ingredients consumed in proportion to the surface area of the workpiece.

Figure 2:
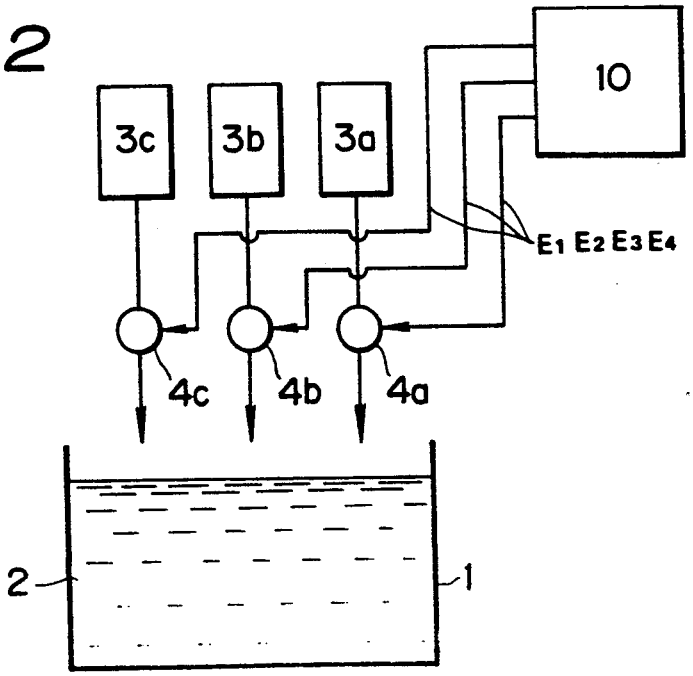
FIG. 2 illustrates another example of replenisher delivery arrangement used in the apparatus of FIG. 1, including separate make-up tanks.

The replenisher contains the consumable ingredient or ingredients of the plating solution 2, that is, cupric ion, a reducing agent, and an alkali as previously mentioned, which are all dissolved in water. These ingredients may be given as a premix, but preferably they are separately prepared and supplied so as to avoid mixing before entering the plating tank. When three separate replenishing agents are used, three independent make-up tanks 3*a*, 3*b*, and 3*c* are preferably set in parallel rather than the single make-up tank as shown in FIG. 2. Along with the replenishment of the consumable ingredients, a stabilizing agent may be replenished in an amount corresponding to the consumed amount, and a complexing agent which is a non-consumable agent may be replenished in an amount corresponding to the amount lost due to drag-out or entrainment on the workpiece. The replenishment of these agents may be accomplished by pre-mixing them with any of the consumable ingredients, cupric ion, reducing agent, and alkali While the replenisher is supplied in this way, the pump 9 is continuously or intermittently actuated to sample the plating solution 2 to the analyzer 8 where the concentration of consumable ingredients is continuously or intermittently measured In this measurement, the preferred subjects whose concentration is to be measured are cupric ion, a reducing agent such as formalin, and an alkali value (pH).

Analysis of these ingredients is not particularly limited and may be selected from a variety of conventional analysis methods. Exemplary analysis methods include absorption spectroscopy for cupric ion, sodium sulfite method for formalin (comprising adding sodium sulfite to the plating solution and neutralization titrating sodium hydroxide resulting from reaction of sodium sulfite and formalin), and neutralization titration for alkali value.

Upon analysis of the concentration of consumable ingredients, the analytical data, that is, a set of information bits F relating to the concentration of consumable ingredients is delivered to the control unit 10 and compared there with the information G of the permissible concentration range of consumable ingredients. No signal is produced when the concentration of consumable ingredients in the plating solution 2 is within the permissible concentration range. A signal E3 or E4 is delivered to the metering pump 4 when the measured concentration is above or below the permissible concentration range. The signal E3 is a signal to interrupt the pump 4 for the predetermined time to stop the supply of the replenisher for the predetermined time. The signal E4 is a signal to control the pump 4 so as to increase the supply of the replenisher by the predetermined quantity. In case the three separate make-up tanks 3*a*, 3*b*, and 3*c* are provided for the respective consumable ingredients as shown in FIG. 2, the concentration of each of the consumable ingredients is analyzed. If any ingredient is found short or excessive, that is, to be adjusted, then one of the metering pumps 4*a*, 4*b*, and 4*c* associated with the make-up tanks 3*a*, 3*b* and 3*c* containing the replenishing agent corresponding to said ingredient is controlledly actuated, thereby interrupting or increasing the supply of the ingredient required of adjustment only.

Plating is effected in the plating solution in which the concentration of a consumable ingredient is always maintained within the permissible concentration range because the consumable ingredient in the plating solution is analyzed and any deviation of the ingredient concentration from the permissible concentration range is promptly corrected.

In the plating solution control method according to the present invention, the control and maintenance of the concentration of the plating solution is accomplished by supplying the replenisher in the amount estimated from the surface area of a workpiece to be plated. Thus, the concentration of the consumable ingredient can deviate from the permissible concentration range to only a least extent. Any considerable time lag which can be introduced between the sampling and the control of the pump 4 based on the analytical result lays little disturbance on the control of the plating solution.

Figure 3:
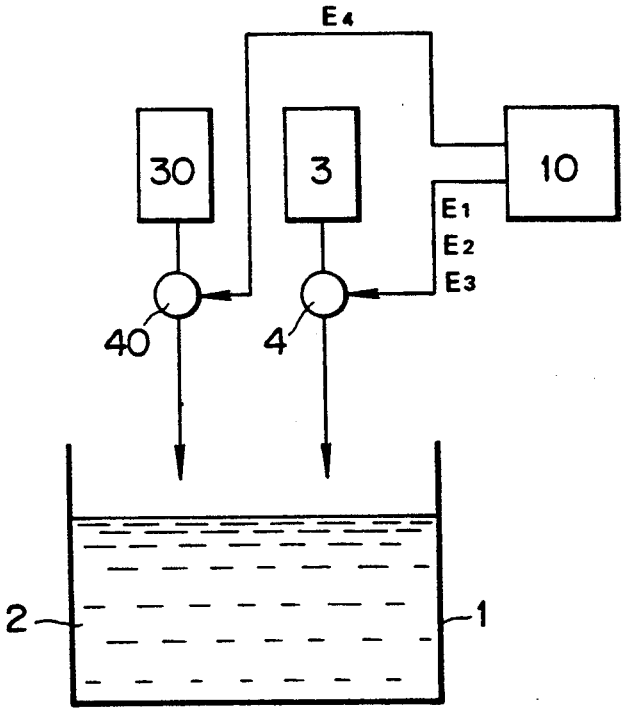
FIG. 3 illustrates a further example of replenisher delivery arrangement used in the apparatus of FIG. 1, including a correcting make-up tank.

In the above-mentioned embodiment of the present plating solution control method, the consumable ingredient or ingredients in the plating solution are analyzed and the pump 4 is controlled to increase the supply of the replenisher when the measured concentration is below the permissible concentration range. The present method, however, is not limited to the foregoing embodiment. An alternative embodiment is shown in FIG. 3 wherein a make-up tank 30 for correction in separately provided in addition to the make-up tank 3. When the concentration of the consumable ingredient in the plating solution 2 is below the permissible concentration range, the control unit 10 delivers a signal E4 to the metering pump 40 of the correcting make-up tank 30 so as to supply a predetermined amount of the replenisher to the plating solution 2 for a predetermined time while the supply of the replenisher in an amount as determined from the surface area of the workpiece is continued without a change. The arrangement of three separate make-up tanks as shown in FIG. 2 may be combined with this alternative embodiment.

In the above-mentioned control process of the electroless copper plating solution, the amounts of the replenisher supplied may be integrated by the control unit 10. When the integrated amount of replenisher supplied reaches a predetermined value, the control unit 10 delivers a signal H to a suitable caution means, for example, an alarm 13 as shown in FIG. 1. Then the degree of aging of the plating solution may be noticed. The amount of the replenisher supplied corresponds to the amount of plating film deposited. Thus, the integrated amount of replenisher supplied corresponds to the integrated amount of plating film deposited. Since the degree of aging of the plating solution corresponds to the integrated amount of plating film deposited, to deliver a signal H at the time when the integrated amount of replenisher supplied has reached the predetermined level is to detect that the degree of aging of the plating solution has reached the predetermined level.

In the case of an electroless copper plating solution containing formalin as a reducing agent, Cannizzaro reaction takes place during non-plating periods as well as during plating periods, leading to spontaneous consumption of formalin and sodium hydroxide. Our study shows that the amounts per unit time of formalin and sodium hydroxide spontaneously consumed due to Cannizzaro reaction is proportional to the temperature if the plating solution composition is constant. By storing in the control unit 10 the information about the amounts per unit time of formalin and sodium hydroxide spontaneously consumed from a certain plating solution composition at varying temperatures, formaline and sodium hydroxide may be replenished in amounts corresponding to their spontaneous consumption amounts throughout the plating and non-plating periods. The spontaneous consumption of formaline and sodium hydroxide due to Cannizzaro reaction becomes considerable in a period from a solution temperature drop at the end of a plating operation to a solution temperature rise at the start of the subsequent plating operation. It is thus preferred to supply formaline and sodium hydroxide in amounts corresponding to the spontaneous consumption during this quiescent period. The replenishment of formaline and sodium hydroxide may be effected for a predetermined time or for every predetermined spontaneous consumption amount of formaline and sodium hydroxide, during the period between temperature drop and rise of the plating solution. It is more convenient to supply them, after the temperature rise and prior to the restart, in amounts corresponding to the spontaneous consumption during the quiescent period between temperature drop and rise. The replenishment of formaline and sodium hydroxide may be effected from either the make-up tank 3 used for the normal replenishment based on the surface area of workpieces or the correcting make-up tank 30. Alternatively, a separate make-up tank containing spontaneously lost ingredients may be provided to supply such ingredients for the replenishment purpose.

Although the foregoing description is made in conjunction with the control of electroless copper plating solution, other electroless plating solutions such as electroless nickel plating solution may also be controlled in a similar way. For the control of other electroless plating solutions, a metal ion, a reducing agent, and an alkali as consumable ingredients are replenished and analyzed in a similar manner to the aforementioned control of electroless copper plating solution. For example, nickel ion, a reducing agent, for example, a hypophosphite such as sodium hypophosphite or a boron reducing agent such as dimethylaminoborane, and an alkali such as sodium hydroxide are replenished and analyzed in controlling an electroless nickel plating solution The control method of the present invention is applicable to not only electroless plating solutions, but also electroplating solutions including nickel and copper electroplating solutions. Particularly when applied to high speed electroplating solutions or electroplating solutions using insoluble anodes, the present control method is effective in maintaining the concentration of metal ion in the plating solution within the permissible range. It should be noted that a consumable ingredient of an electroplating solution is the metal ion essential to the electroplating solution to be controlled, for example, nickel ion for nickel electroplating solution and copper ion for copper electroplating solution. When applied to brightener-containing electroplating solutions (the brightener is an additional consumable ingredient as well as the metal ion) and composite electroplating solutions having inorganic or organic fine particles suspended therein (the particulate material is an additional consumable ingredient as well as the mtal ion), the present control method is useful in controlling the amount of the brightener or particles. The following modification must be made when the present control method is applied to electroplating solutions. In the case of electroplating, plating temperature may be maintained constant although it gives no substantial influence on deposition amount (weight or thickness) and speed. Rather, cathode current density largely affects the amount of plating film deposited per unit time as well as plating solution composition and workpiece surface area. Thus, a set of information bits relating to a given plating solution composition and the deposition amounts per unit time from the plating solution at varying cathode current densities, or the amount of consumable ingredients to be consumed, or the amount of a replenisher to be supplied is stored in the control unit. The control unit also receives sets of information about the cathode current density in an instant plating operation and the surface area of a workpiece. Then the control unit computes the estimated deposition amounts of the plating solution per unit time, or the amount of consumable ingredients to be consumed, or the amount of a replenisher to be supplied with respect to the workpiece. The remaining control procedures are substantially the same as previously described for the electroless copper plating solution.

An example of the present invention are given below by way of illustration and not by way of limitation.

EXAMPLE

An electroless copper plating solution having the following composition was controlled using the apparatus shown in FIGS. 1 and 2.

| Plating solution composition | |
|---|---|
| Copper sulfate (as cupper ion) | 2–3 gram/liter (standard 2.5 gram/liter) |

-continued

| | |
|---|---|
| Formaldehyde | 2.1–2.7 gram/liter (standard 2.4 gram/liter) |
| Sodium hydroxide | 3–4 gram/liter (standard 3.5 gram/liter) |
| Diethylenetriaminepentaacetic acid | 0.08 mol/liter |
| $\alpha,\alpha'$-dipyridyl | 40 mg/liter |
| Nonionic surfactant | 30 mg/liter |
| Plating conditions | |
| Workpiece | Printed circuit board |
| Workpiece surface area | 780 $dm^2$ |
| Plating solution volume | 260 liters |
| Bath ratio | 1–4 $dm^2$/liter (standard 3 $dm^2$/liter) |
| Temperature | 53–57° C. (standard 55° C.) |
| Time | 30 min. |
| Deposit thickness | 1.5–2 μm |
| Replenishers | |
| I Copper sulfate (as copper ion) | 32.8 gram/liter |
| Commercial 37% formalin | 102 gram/liter |
| II Sodium hydroxide | 180 gram/liter |
| III Two-fold dilution of commercial 37% formalin | |

Control procedure

The electroless copper plating solution was controlled by by first heating the plating solution 2 with the heater 5. The thermometer 6 took the temperature of the plating solution 2 and the thermoregulator 7 turned on or off the heater 5 in accordance with the measurement of the thermometer 6 so as to maintain the plating solution temperature at 55° C. At the same time, the thermoregulator 7 supplied temperature information C to the control unit 10. Information B relating to the surface area of a workpiece to be subjected to electroless plating was also input to the control unit 10. Upon receipt of surface area information B and temperature information C, the control unit 10, which had stored therein information A relating to the amounts of replenishers I, II, and III to be supplied, computed the amounts of replenishers I, II, and III to be supplied per unit time. Now the workpiece 11 was admitted into the plating tank 1. The detector 12 sensed the presence of the workpiece and delivered a signal D to the control unit 10. Upon receipt of the signal D, the control unit 10 delivered a signal E to the metering pumps 4a, 4b, 4c to control the pumps in accordance with the result of the preceding computation so as to turn on and off at predetermined time intervals. In this way, the replenishers I, II, III were supplied from the make-up tanks 3a, 3b, 3c to the electroless copper plating solution 2 in amounts corresponding to the amounts of the consumable ingredients (cupric ion, formalin, and sodium hydroxide) consumed from the plating solution which in turn corresponded to the plating temperature and the workpiece surface area.

While the plating solution 2 was consumed of its consumable ingredients during the plating of the workpiece 11, the consumable ingredients were replenished in substantially the same amounts as consumed. Thus the concentration of the consumable ingredients was always kept substantially constant After the workpiece 11 was subjected to electroless copper plating for 30 minutes, it was removed from the plating tank 1. The detector 12 sensed the removal of the workpiece 11 from the tank 1 and produced a signal D2 to the control unit 10, which in turn delivered a signal E2 to the metering pumps 4a, 4b, 4c to interrupt the operation thereof to stop the supply of the replenishers.

A similar control process was followed when it was desired to plate a fresh workpiece 11. The flow rate and operating time of the metering pumps were determined on the basis of a set of information bits B relating to the surface area of the new workpiece, thereby supplying the replenishers in amounts corresponding to the amounts of consumable ingredients consumed in proportion to the surface area of the workpiece.

While the replenishers I, II, III were supplied in this way, the pump 9 was continuously or intermittently actuated to sample the plating solution 2 to the analyzer 8 where the concentration of consumable ingredients was continuously or intermittently measured.

In this measurement, the preferred subjects whose concentration is to be measured were cupric ion, formalin, and NaOH. Cu ion was analyzed by absorption spectroscopy, formalin by sodium sulfite method, and NaOH by neutralization titration.

Upon analysis of the concentration of consumable ingredients, the analytical data, that is, a set of information bits F relating to the concentration of consumable ingredients was delivered to the control unit 10 and compared there with the information G of the permissible concentration range of consumable ingredients. No signal was produced when the concentrations of consumable ingredients in the plating solution 2 were within the permissible concentration ranges. A signal E3 or E4 was delivered to the metering pump 4 when the measured concentrations were above the upper limits (that is, above 3 gram/liter of cupric ion, 2.7 gram/liter of formaldehyde, or 4 gram/liter of NaOH) or below the lower limits (that is, below 2 gram/liter of cupric ion, 2.1 gram/liter of formaldehyde, or 3 gram/liter of NaOH) of the permissible concentration ranges. Upon receipt of signal E3, the pumps 4*a*, 4*b*, 4*c* were interrupted for the predetermined time to stop the supply of the replenishers for the predetermined time. Upon receipt of signal E4, the pumps 4*a*, 4*b*, 4*c* were controlled so as to increase the supply of the replenishers by the predetermined quantity.

With the aforementioned procedure, plating continued for a total of 48 hours. The results of analysis of the plating solution during the process are shown below.

| | Initial | 24 hour | 48 hours |
|---|---|---|---|
| Cupric ion | 2.5 g/l | 2.5 g/l | 2.5 g/l |
| Formaldehyde | 2.4 g/l | 2.5 g/l | 2.4 g/l |
| NaOH | 3.5 g/l | 3.4 g/l | 3.5 g/l |
| Appearance of deposit | bright pink | bright pink | bright pink |

It was demonstrated that the present control method can well maintain the concentration of an electroless copper plating solution while producing copper deposits having good appearance and physical properties.

I claim:

1. An apparatus for automatically and continuously controlling a concentration of an electroplating solution comprising:

a plating tank containing an electroplating solution therein, a make-up tank containing a replenisher therein, a supply means for supplying the replenisher in the make-up tank into the plating solution in the plating tank, an analyzer for measuring a concentration of a consumable ingredient in the plating solution, a detector for detecting whether or not a workpiece to be plated in introduced in the plating solution, and a control unit having a computer incorporated therein and operatively interconnected to a pump, thermoregulator, and analyzer, said control unit having stored therein a set of information bits A relating to a plating solution composition and the deposition amounts per unit time from the plating solution at varying temperatures and surface areas of a workpiece to be plated, or the amount of a replenisher to be supplied, and receiving a set of information bits B relating to the surface area of a workpiece to belated and a set of information bits C relating to the current density from an electric source for electroplating in order that upon receipt of surface area information B and current density information C, the control unit computes the amount of plating film to be deposited on the workpiece per unit time, or the amount of a consumable ingredient to be consumed, or the amount of replenisher to be supplied, wherein when the workpiece of dipped in the plating tank, the detector delivers a signal D1 indicative of the presence of the workpiece in the tank to the control unit and the control unit then supplies a signal E1 based on the result of the preceding computation to the supply means to actuate the supply means so as to provide a predetermined flow rate for a predetermined time, thereby making up the plating solution with a predetermined amount of the replenishment over a predetermined time, and when the workpiece is thereafter taken out of the plating tank, the detector gives another signal D2 indicative of the absence of the workpiece in the tank to the control unit and the control unit then supplies another signal E2 to the supplying means to interrupt the operation thereof, said control unit being connected to the analyzer whereby a set of information bits F relating to the concentration of consumable ingredient is delivered from the analyzer to the control unit in order that comparing information F with a previously stored set of information bits G relating to the permissible concentration range of the consumable ingredient in the plating solution, the control unit delivers a signal E3 to the supplying means to interrupt its operation for a predetermined time to thereby interrupt the supply of the replenisher for the predetermined time when the concentration of consumable ingredient in the plating solution exceeds the permissible concentration range, or the control unit delivers another signal E4 to the supplying means when the concentration of consumable ingredient in the plating solution is below the permissible concentration range so that signal E4 commands the supplying means to increase the flow rate therethrough by a predetermined quantity and/or extend the operating duration thereof by a predetermined time to thereby increase the supply of the replenisher by a predetermined amount, whereby a workpiece is electroplated at a permissible concentration range of a consumable ingredient in the plating solution which is maintained by supplying the replenisher in an amount corresponding to the amount of the consumable ingredient determined from the surface area of the workpiece and by insuring whether or not the concentration is maintained within the permissible range by analyzing the consumable ingredient in the plating solution.

* * * * *